US006345979B1

(12) United States Patent
Taylor et al.

(10) Patent No.: US 6,345,979 B1
(45) Date of Patent: Feb. 12, 2002

(54) OXYGEN-FUEL PILOT WITH INTEGRAL IGNITION

(75) Inventors: Curtis L. Taylor, Muncie; Daniel A. Ertl, Noblesville; Bradley D. Watt, Selma, all of IN (US)

(73) Assignee: Maxon Corporation, Muncie, IN (US)

( * ) Notice: Subject to any disclaimer, the term of this patent is extended or adjusted under 35 U.S.C. 154(b) by 0 days.

(21) Appl. No.: 09/555,225

(22) PCT Filed: Nov. 25, 1999

(86) PCT No.: PCT/US98/25240

§ 371 Date: May 25, 2000

§ 102(e) Date: May 25, 2000

(87) PCT Pub. No.: WO99/27303

PCT Pub. Date: Jun. 3, 1999

Related U.S. Application Data

(60) Provisional application No. 60/066,869, filed on Nov. 25, 1997.

(51) Int. Cl.[7] ..... F23Q 9/00

(52) U.S. Cl. ..... 431/266; 431/285; 431/353

(58) Field of Search ..... 431/264, 265, 431/266, 353, 10, 127, 128, 191, 192, 193, 194, 254, 258, 285; 60/39, 826

(56) References Cited

U.S. PATENT DOCUMENTS 2,996,113 A 8/1961 Williams

*Primary Examiner*—Carl D. Price
(74) *Attorney, Agent, or Firm*—Barnes & Thornburg

(57) ABSTRACT

A burner (10, 210) is provided in accordance with the present invention that includes an outer tube (62), an inner tube (34) positioned to be within the inner tube (34), a power supply (38) coupled to the inner tube (34), and an ignitor pin (70) coupled to the outer tube (62). An insulator (16) is provided that separates the burner (10) from a natural gas supply (28). The natural gas supply (28) provides natural gas to a combustion zone (45) through the inner tube (34). An oxygen supply (58) provides oxygen to the combustion zone (45) through a gap (144) between inner and outer tubes (34, 62). A spark is created between the inner tube (34) and the ignitor pin (70) to ignite the natural gas and oxygen to create a flame (12).

19 Claims, 5 Drawing Sheets

OXYGEN-FUEL PILOT WITH INTEGRAL IGNITION

This patent application claims priority to U.S. Provisional Application Ser. No. 60/066,869 filed Nov. 25, 1997 which is expressly incorporated by reference herein.

BACKGROUND AND SUMMARY OF THE INVENTION

The present invention relates to industrial burners, and particularly to a small air/fuel or oxygen/fuel burner. More particularly, the present invention relates to a spark-ignition burner which can be used as a small self-sufficient burner or as a pilot ignition service for a larger burner.

Burners are frequently used in industrial environments to provide heat to various processes. For example, burners are used to provide heat to boilers, furnaces, kilns, rotary dryers, fume incinerators, pollutant-burning afterburners, and laboratory equipment. Some burners are also used as pilots that ignite larger burners. Many burners are configured to convert air and fuel into a combustible air-and-fuel mixture which is then ignited to produce a flame for providing heat to a process.

According to the present invention, a burner includes an outer conduit and an electrical spark generator including an inner conduit passing through a passageway formed in the outer conduit. Fuel discharged from an outlet formed in the inner conduit mixes with oxygen passing through the passageway formed in the outer conduit in a combustion zone within that passageway to create a combustible oxygen and fuel mixture in the combustion zone.

The electrical spark generator further includes an electrical current provider and a ground pin. The electrical current provider is coupled to the inner conduit to establish a flow of electrical current through the inner conduit. The ground pin is positioned to lie in the combustion zone established within the passageway formed in the outer conduit. An electrical arc is formed in the combustion zone between the inner conduit and the ground pin to create a spark and ignite the combustible mixture of oxygen and fuel extant in the combustion zone.

An insulator is coupled to the inner conduit and a connector is coupled to the insulator and the outer conduit to support the inner conduit in the passageway formed in the outer conduit. The insulator is formed to include a passageway receiving a portion of the inner conduit therein. Another insulator is provided to lie between a fuel supply and the inner tube and is formed to conduct fuel passing from the fuel supply into the inner conduit.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
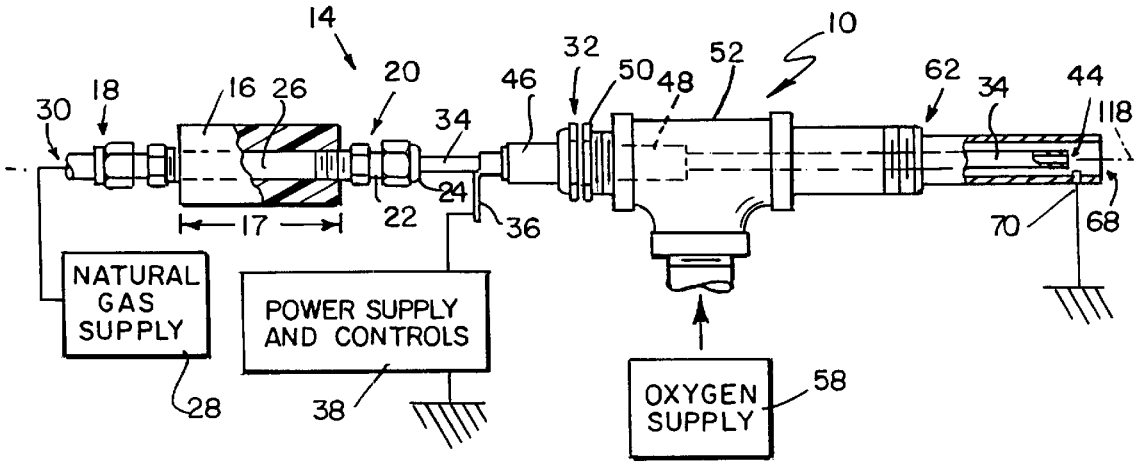
FIG. 1 is a side elevational view of a burner showing an outer tube conducting oxygen from an oxygen supply through a passageway formed in the outer tube, an inner tube extending through the passageway and discharging fuel provided by a natural gas supply into a combustion zone provided in the outer tube passageway and a power supply electrically coupled to the inner tube and operable to generate a spark between the inner tube and a grounded ignition pin coupled to the outer tube to ignite a combustible mixture extant in the combustion zone, the inner tube being coupled at one end to a first insulator and passing through a second insulator positioned to lie between the first insulator and the combustion zone.
Figure 2:
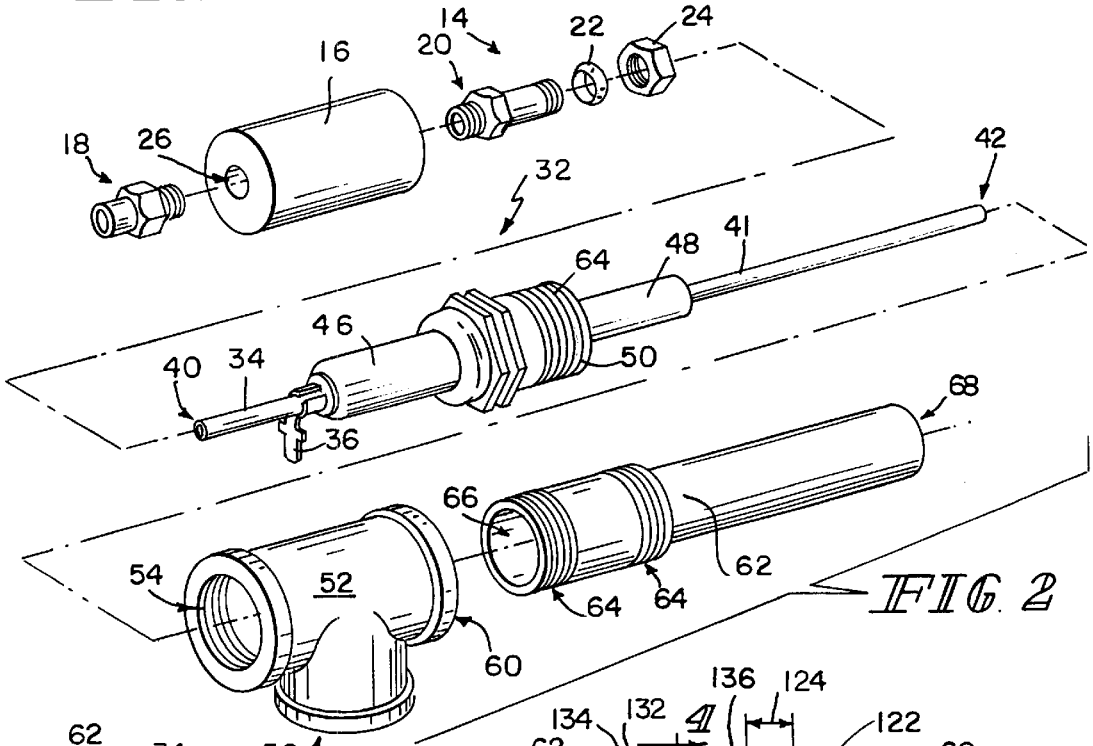
FIG. 2 is an exploded perspective view of components of the burner and the first insulator showing the position in which the burner components are assembled to form a working burner and showing the fuel-conducting inner tube arranged to pass through the second insulator.

A spark-ignition burner 10 is provided to mix oxygen and natural gas in a combustion zone 45 to produce a flame 12 (see FIG. 3) and is configured for use as a burner or a pilot ignition apparatus in a larger burner. The burner 10 comprises various modular units which are easily assembled together. The first modular unit 14 comprises a fitting 20, a compression ring 22, and a connector 24, as shown in FIGS. 1 and 2. An insulator 16 is positioned to be between burner 10 and a natural gas supply 28. Fuel other than natural gas may also be used in burner 10.

Insulator 16 is made of PVC plastic and includes a length 17 of about 2 inches (5 centimeters). It is within the scope of the disclosure to make the insulator of alternate materials such as MACOR or machinable glass ceramic and of a shorter or a longer length. Insulator 16 is hollow, thereby forming a passageway 26 through which fuel, for example, can flow. A fitting 18 is connected to natural gas supply 28 and gas flows into fitting 18 at a natural gas inlet 30.

A second modular unit 32 comprises an inner tube 34 configured to conduct fuel therethrough, an ignitor clip 36, porcelain blocks 46, 48, and a connector 50. Inner tube 34 is made of stainless steel and includes two opposite ends 40, 42 and a hollow body 41 extending therebetween. Porcelain blocks 46, 48 act as insulators as described below and thus cooperate to define a second insulator spaced-apart from first insulator 16 as shown, for example, in FIG. 1. Ignitor clip 36, also made of stainless steel, is coupled to inner tube 34 by, for example, welding. Ignitor clip 36 is also coupled to a power supply 38 as shown in FIG. 1.

The power supply 38 provides the ignitor clip 36 with a constant supply of current until ignition occurs. By providing ignitor clip 36 at end 40 of the inner tube 34 with current from the power supply 38, inner tube 34 is an electrical conduit charged with current. Opposite end 42 of the inner tube 34 includes the fuel-dispensing outlet 44 for the natural gas flowing therethrough that leads to a combustion zone 45. Thus, inner tube 34 is a gas conduit as well as an electrical conduit. Porcelain blocks 46, 48 surround inner tube 34 and connector 50 surrounds porcelain blocks 46, 48 as shown in FIGS. 1 and 2. Porcelain blocks 46, 48 act as insulators to prevent current from running from inside tube 34 to connector 50. Fuel-conducting inner tube 34 passes through the insulator defined by porcelain blocks 46, 48 as shown, for example, in FIGS. 1 and 2.

Second modular unit 32 connects with first modular unit 14 as inner tube 34 is received by fitting 20, compression ring 22, and connector 24 as shown in FIG. 1. Compression ring 22 and connector 24 are tightened down around fitting 20 thereby securing end 40 of inner tube 34 within fitting 20. Because fittings 18, 20, compression ring 22, and connector 24 are made of steel, a conductive material, insulator 16 is provided to block the flow of electricity provided by power supply 38 from flowing to natural gas supply 28 and the rest of the plant (not shown) which may contain electrically sensitive equipment (not shown).

Insulator 16 provides a physical electric separator or barrier between natural gas supply 28 and fitting 20 and the remainder of burner 10. Thus, stray voltages from power supply 38 are blocked and prevented from traveling to natural gas supply 28 by insulator 16. This provides protection to natural gas supply 28 and any electrically sensitive equipment in electrical communication with natural gas supply 28.

As shown in FIGS. 1 and 2, a three-way connector 52 is provided having a third opening 54 coupled to connector 50 of the second modular part 32, a second opening 56 connected to an oxygen supply 58, and a first opening 60 connected to an outer tube 62. Thus, outer tube 62 is a gas conduit providing oxygen to combustion zone 45 and inner and outer tubes 34, 62 provide a gas conduit providing both natural gas and oxygen to combustion zone 45. Connector 50 and outer tube 62 are shown to include pipe threads 64 which provide air-tight and water-tight seals. Thus, no extra sealing measures are required to seal between connector 50 and outer tube 62. Alternatively, the second modular unit and the outer tube may be connected to the three-way connector by an O-ring connection, silver solder, a press fit, or any other coupling method.

Figure 3:
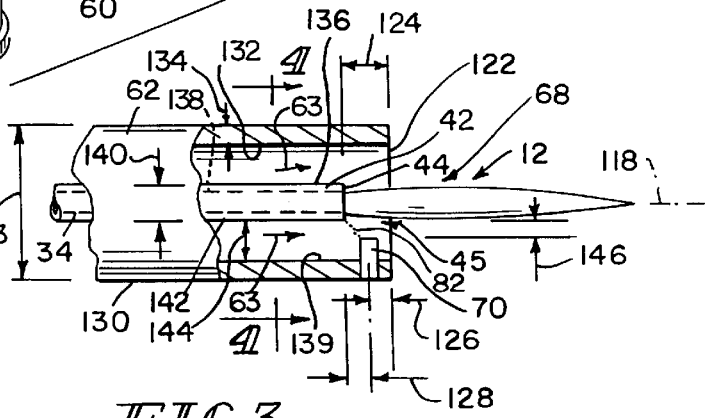
FIG. 3 is a side elevational view, with portions cut away, showing the combustion zone in the fuel-dispensing outlet of the burner where the oxygen and natural gas mix to form a narrow, uniform flame and showing placement of a portion of the grounded ignition pin in the combustion zone so as to generate a spark therein to ignite a combustible oxygen and fuel mixture passing therethrough.

Outer tube 62 includes opposite ends 66, 68 and an ignition or ground pin 70 is located at end 68 as shown in FIGS. 1 and 3. Ignition pin 70 is connected to ground 72. Inner tube 34 lies within outer tube 62 so that fuel-dispensing outlet 44 of inner tube 34 is in close proximity of ignition pin 70 and provides a spark gap 82. Spark gap 82 is the distance between end 42 of inner tube 34 and ignition pin 70. Thus, power supply 38, ignitor clip 36, inner tube 34, and ignitor pin 70 connected to ground 72 provide an electric spark generator that creates a spark across spark gap 82 that ignites the combustion of the natural gas and oxygen within combustion zone 45.

Burner 10 includes a central axis 118 at shown in FIG. 1. End 68 of outer tube 62 is formed to include a rim 120 defining an outlet 122 that is spaced axially outward from fuel-dispensing outlet 44 of inner tube 34 along central axis 118 by a distance 124. Outlet 122 is also spaced axially outward from ignition pin 70 by a distance 126 as shown in FIG. 3. Fuel-dispensing outlet 44 is spaced axially inward from ignition pin 70 by a distance 128.

Figure 4:
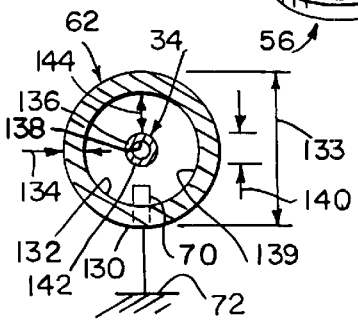
FIG. 4 is a cross-sectional view taken along line 4—4 of FIG. 3 showing the inner tube positioned to lie within the outer tube to create a spark gap therebetween.

Outer tube 62 includes an outer surface 130, an inner surface 132 facing away from outer surface 130, an outer diameter 133, and a radial thickness 134 measured between outer surface 130 and inner surface 132. Inner tube 34 includes an outer surface 136 facing toward inner surface 132 of outer tube 62, an inner surface 138 facing away from outer surface 136, an outer diameter 140, and a radial thickness 142 measured between outer surface 136 and inner surface 138. A radial gap 144 (measured between inner surface 132 of outer tube 62 and outer surface 136 of inner tube 34) creates a passageway 139 for oxygen to travel to combustion zone 45. Gap 144 is greater than radial thickness 134 of outer tube 62 as shown in FIG. 4. Another radial gap 146 (measured radially between fuel-dispensing outlet 44 and ignition pin 70) and distance 128 create spark gap 82.

According to a preferred embodiment of the present disclosure, distance 124 is 0.422 inches (1.07 centimeters); distance 126 is 0.297 inches (0.751 centimeters); distance 128 is 0.125 inches (0.316 centimeters); outer diameter 133 is 0.587 inches (1.49 centimeters); radial thickness 134 is 0.06 inches (0.152 centimeters); outer diameter 140 is 0.1875 inches (0.474 centimeters); radial thickness 142 is 0.02 inches (0.0506 centimeters); gap 144 is 0.140 inches (0.354 centimeters); and radial gap 146 is 0.06 inches (0.152 centimeters). Many other variations of these dimensions are also within the scope of the present disclosure.

Burner 10 operates such that natural gas flowing from natural gas supply 28 enters fitting 18 at natural gas inlet 30. The gas then flows through first insulator 16 and fitting 20 to inner tube 34. Oxygen from the oxygen supply 58 flows through outer tube 62 and around inner tube 34 through passageway 139 in direction 63 as indicated in FIG. 3. The inner tube 34 carries the gas through second insulator 46, 48 and keeps it separated from the oxygen until the gas exits at end 42 into combustion zone 45.

Inner tube 34 also carries, as stated before, the electrical current for the spark ignition means. Because of the close proximity of grounded ignition pin 70 and electrically charged inner tube 34, the current provided by power supply 38 and traveling through inner tube 34 jumps from inner tube 34 to ignition pin 70 to form an electrical arc within combustion zone 45. Ignition pin 70 is positioned to lie within outer tube 62 as shown in FIG. 3 and is located near fuel-dispensing outlet 44 of inner tube 34. As the natural gas and the oxygen mix at the fuel-dispensing outlet 44, the electric arc between ignition pin 70 and inner tube 34 creates an ignition force for igniting flame 12 as shown in FIG. 3. Thus, ignitor pin 70 provides an ignitor extension to which the electrical arc jumps.

Because fuel-dispensing outlet 44 of inner tube 34 is axially inset from outlet 122 of outer tube 62, smooth laminar flow exists at outlet 122. This laminar flow produces a non-turbulent, narrow flame 12. Because flame 12 is narrow, localized hot spots are reduced at outlet 122. Thus, no turbulent "flame wash" is produced that could reduce the useful life of a burner or degrade any other surrounding material that is susceptible to high temperatures.

Figure 5:
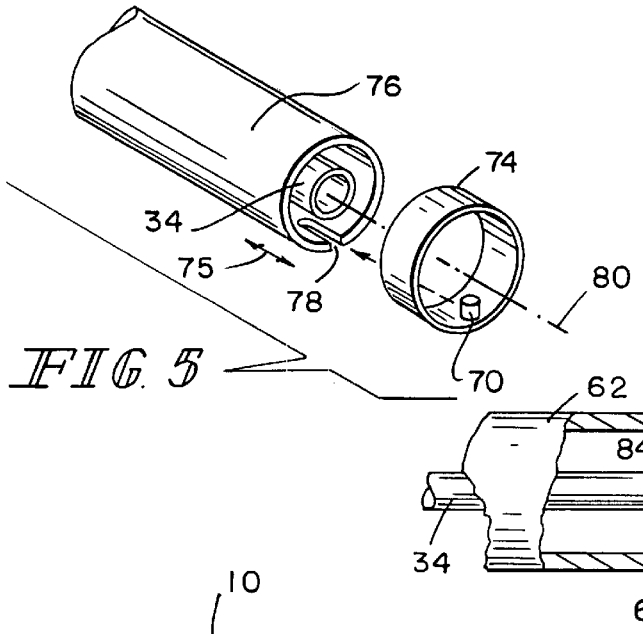
FIG. 5 is a perspective view of an alternative embodiment of a burner including a sleeve having a movable ignition pin which permits a user to adjust a spark gap distance between the ignition pin and the inner tube.

An alternative embodiment is provided in FIG. 5 wherein ignition pin 70 is coupled to a sleeve 74 and an outer tube 76 includes an aperture or notch 78.

Ignition pin 70 is movable back and forth in directions 75 through notch 78 relative to outer tube 76 between a plurality of positions. As sleeve 74 moves in direction 75 along axis 80 of outer tube 76, spark gap 82 increases or decreases. Thus, the position of ignition pin 70 relative to inner tube 34 is adjustable. Because the distance between ignition pin 70 and inner tube 34 is adjustable, spark gap 82 (see, for example, FIG. 3) is also adjustable. It is advantageous to be able to adjust the position of ignition pin 70 as a fine adjustment for setting an optimum spark gap 82 during installation and setup of the burner 10. Thus, sleeve 74 provides a portion of an adjustable electric spark generator. Although FIG. 5 illustrates an adjustable spark gap 82 through the use of a movable sleeve 74 to which the ignition pin 70 has been attached, it is within the scope of the invention to include any type of fixture apparatus for fixing movable sleeve 74 at a fixed position relative to outer tube 76 to "fine tune" the position of ignition pin 70 relative to inner tube 34.

Figure 6:
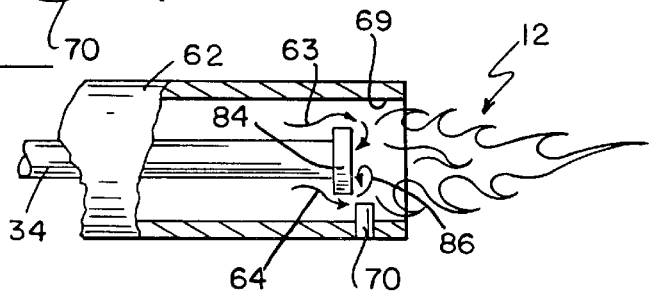
FIG. 6 is a side elevational view, with portions cut away, of an alternative embodiment showing a bluff body at the tip of the inner tube so that air, instead of oxygen, traveling through the outer tube can be mixed with the natural gas discharged from the inner tube forming a less uniform flame.

In another alternative embodiment of the present invention, air or air with varying grades of oxygen may be used instead of pure oxygen to run through outer tube 62 as shown, for example, in FIG. 6. When air instead of oxygen is mixed with fuel from inner tube 34, a bluff body 84 may be attached to inner tube 34. A bluff body 84 creates turbulent eddies 86 formed as the air travels through passageway 139 in outer tube 62 in direction 63 and mixes with the fuel from inner tube 34 before traveling out an outlet opening 69 of outer tube 62. Because of the turbulent flow, a much less uniform flame 12 is produced.

Figure 7:
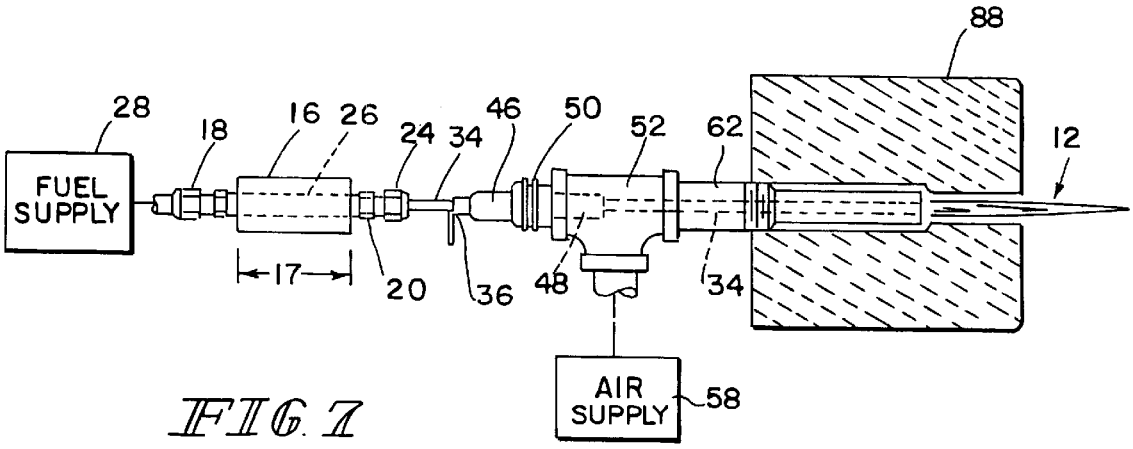
FIG. 7 is a side elevational view of the present invention showing the ignition end of the burner to contained within a ceramic block for insertion into a refractory furnace.

In an alternative embodiment shown in FIG. 7, ceramic block 88 is attached to burner 10 by cementing ceramic block 88 around outer tube 62. It is often necessary to insert burner 10 into a refractory furnace (not shown) made of multiple bricks. Attaching ceramic block 88 to burner 10 allows burner 10 to be installed into the refractory furnace without the need to make additional adjustments or inlet holes to the furnace itself. The ceramic block 88 acts as one of the existing blocks or bricks already in the furnace. Because flame 12 is narrow, it does not strike block 88 which could cause undesirable high temperature to develop on block 88. Ceramic block 88 can be provided in various shapes and sizes to fit a plurality of refractory furnaces.

Figure 9:
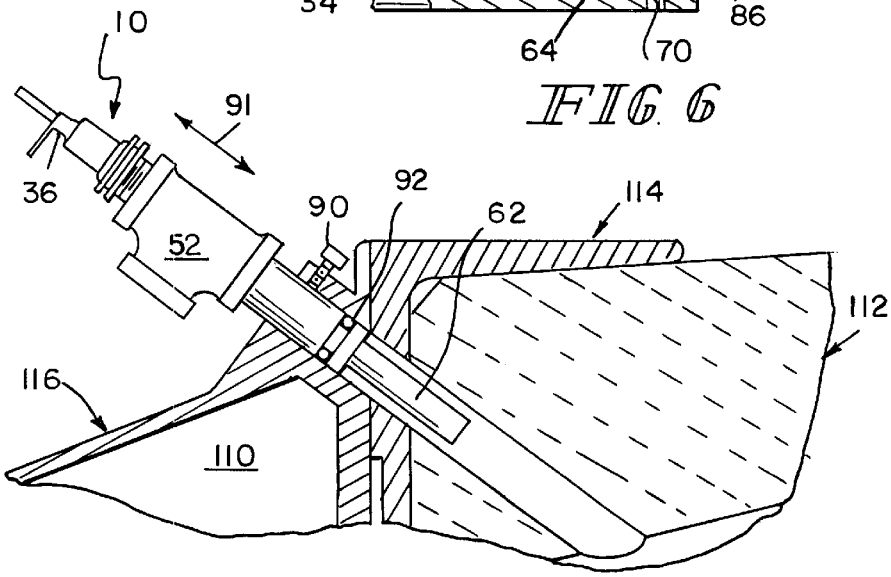
FIG. 9 is a side elevational view, with portions cut away, of yet another alternative embodiment showing the burner being used as a pilot for a larger burner, the pilot including an O-ring used as a seal and a set screw for holding the pilot in place within the burner.
Figure 8:
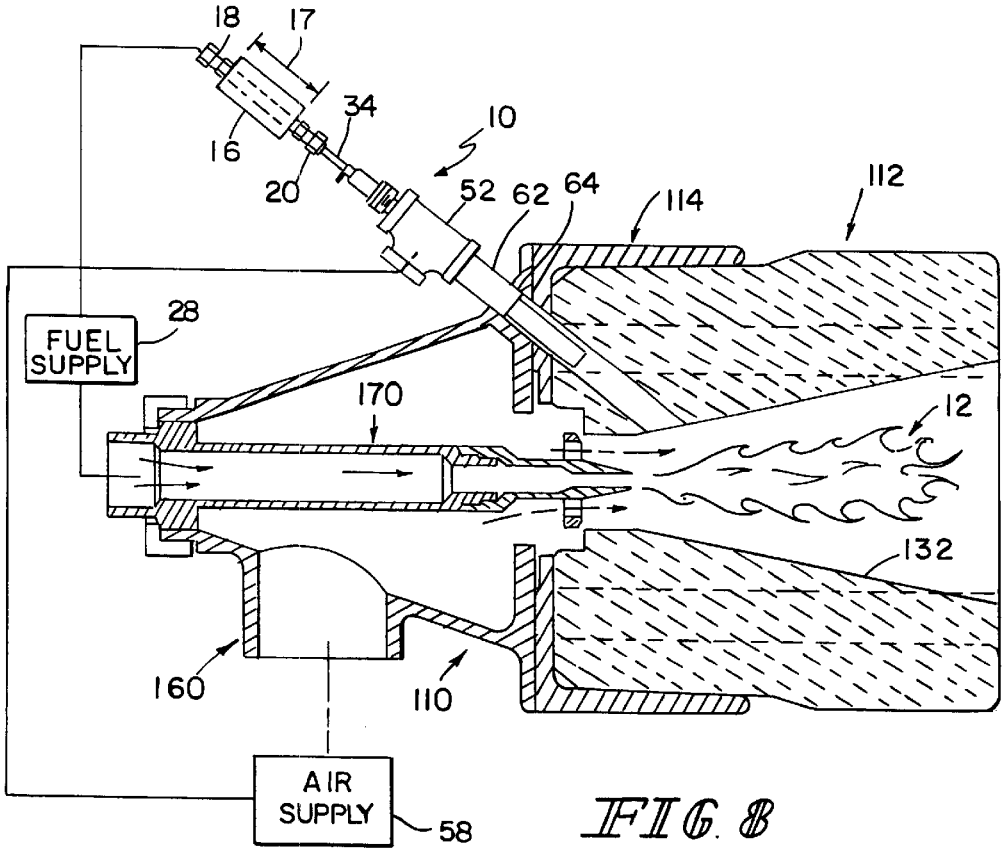
FIG. 8 is a side elevational view, with portions cut away, of the burner mounted within a larger burner and used as a pilot for starting the larger burner, the pilot burner being sealed and secured to the larger burner by a threaded connection between the larger burner and the burner.

Burner 10 may be used alone as a small self-sufficient burner or as a pilot ignition service for a larger burner 110 as shown in FIG. 8. As shown in FIG. 8, large burner 110 includes a gas conduit 170, an oxygen-admission port 160, an oxygen-supply housing 116, and a frame 114 mounted in an inlet end of a burner block 112 is provided. Further details of a burner system similar to that shown in FIG. 9 are described in U.S. Pat. No. 5,458,483, the subject matter of which is expressly incorporated by reference herein. Burner 10 is mounted to burner 110 for use as a pilot burner to aid in the ignition of burner 110. Burner 110 discharges a flame 12 into a flame chamber 132 as shown in FIG. 8. Pilot burner 10 is needed, for example, when larger burner 110 is shut off frequently or perhaps at the end of each day. Many burners are self igniting in hot temperature environments (e.g. about 1200° F., 650° C.); however, if the burner is turned off so frequently that temperatures do not always remain high enough to self ignite, a pilot burner is needed. As shown in FIG. 8, pilot burner 10 is identical to burner 10 shown in FIGS. 1 and 2. Pilot burner 10 is mounted to burner 110 through the use of pipe threads 64 located around outer tube 62. As stated previously, pipe threads 64 are air and water tight and, therefore, eliminate the need for an additional seal. Pilot burner 10 is shown mounted at the top of burner 110. However, it is within the scope of the invention that burner 10 may be mounted to burner 110 in any of a variety of locations.

Figure 10:
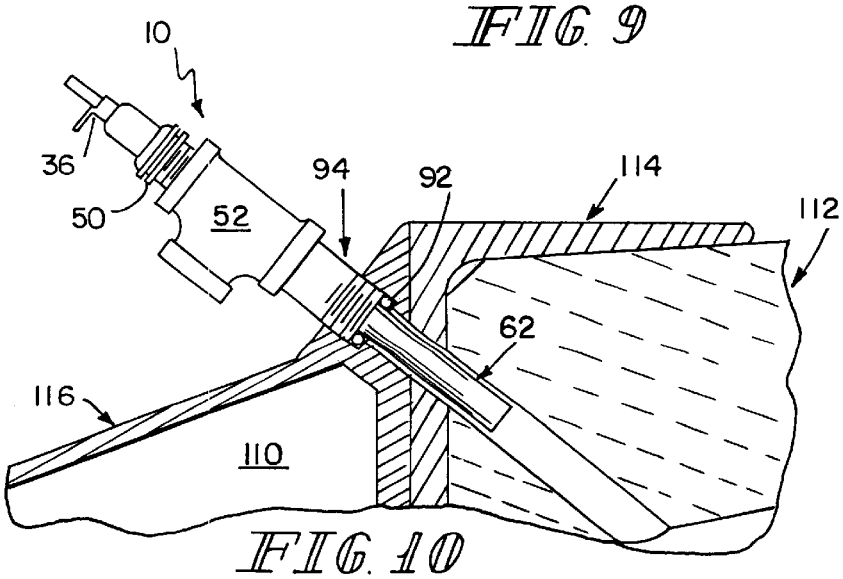
FIG. 10 is a side elevational view, with portions cut away, of still another alternative embodiment showing the burner as a pilot for a larger burner, the pilot including an O-ring used as a seal and the outer tube comprising machine threads for securing the pilot burner within the larger burner.

In further alternative embodiments where burner 10 is used as a pilot burner for larger burners 110, pilot burner 10 may be attached by means other than pipe threads 64. For example, FIG. 9 shows burner 10 inserted in direction 91 and mounted to burner 110 through the use of a set screw 90 drilled through burner 110 and into outer tube 62 of pilot burner 10. An O-ring 92 may be added around outer tube 34 to produce an air-tight or water-tight seal. O-ring 92 provides the necessary seal needed between the two burners 10, 110. FIG. 10 shows an alternative embodiment where machine threads 94 are used for securing pilot burner 10 to burner 110. O-ring 92 is provided to create an air-tight and water-tight seal. In addition, the pilot burner 10 may be cemented (not shown) into the larger burner 110 without the use of O-ring 92 for purposes of permanently sealing the pilot burner 10 within the larger burner 110.

Figures 11, 13:
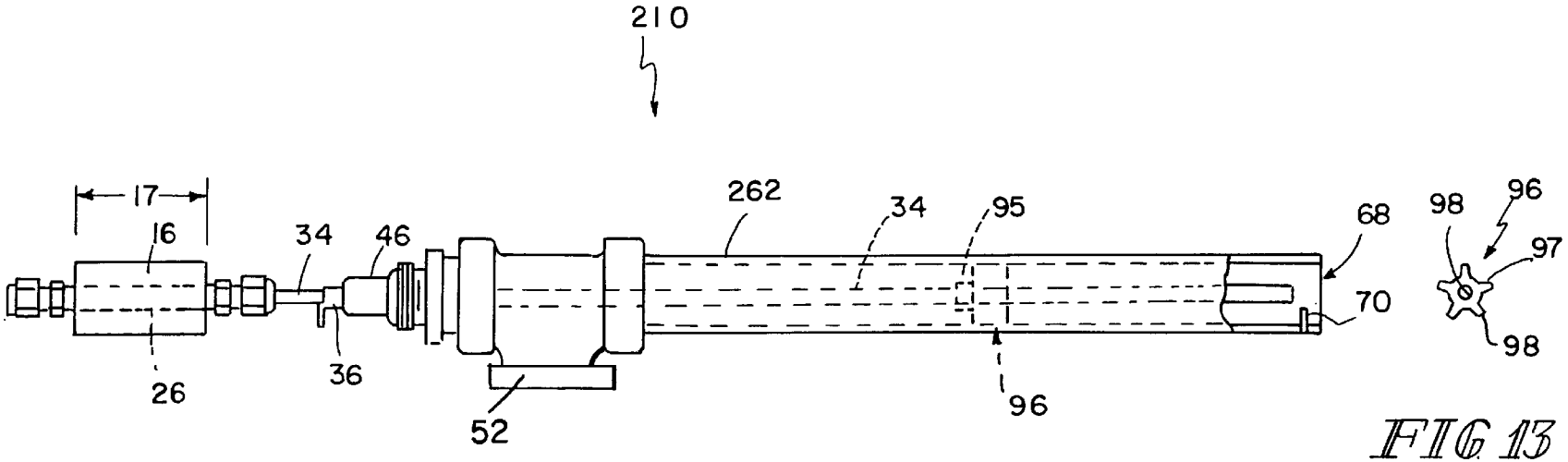
FIG. 11 is a side elevational view of an alternative embodiment showing the burner including a ceramic star insulator (in phantom) for supporting a portion of the weight of the inner tube to prevent the inner tube from engaging and grounding out with the ignition pin.
FIG. 13 is a front view of the ceramic star insulator shown in FIGS. 11 and 12.
Figure 12:
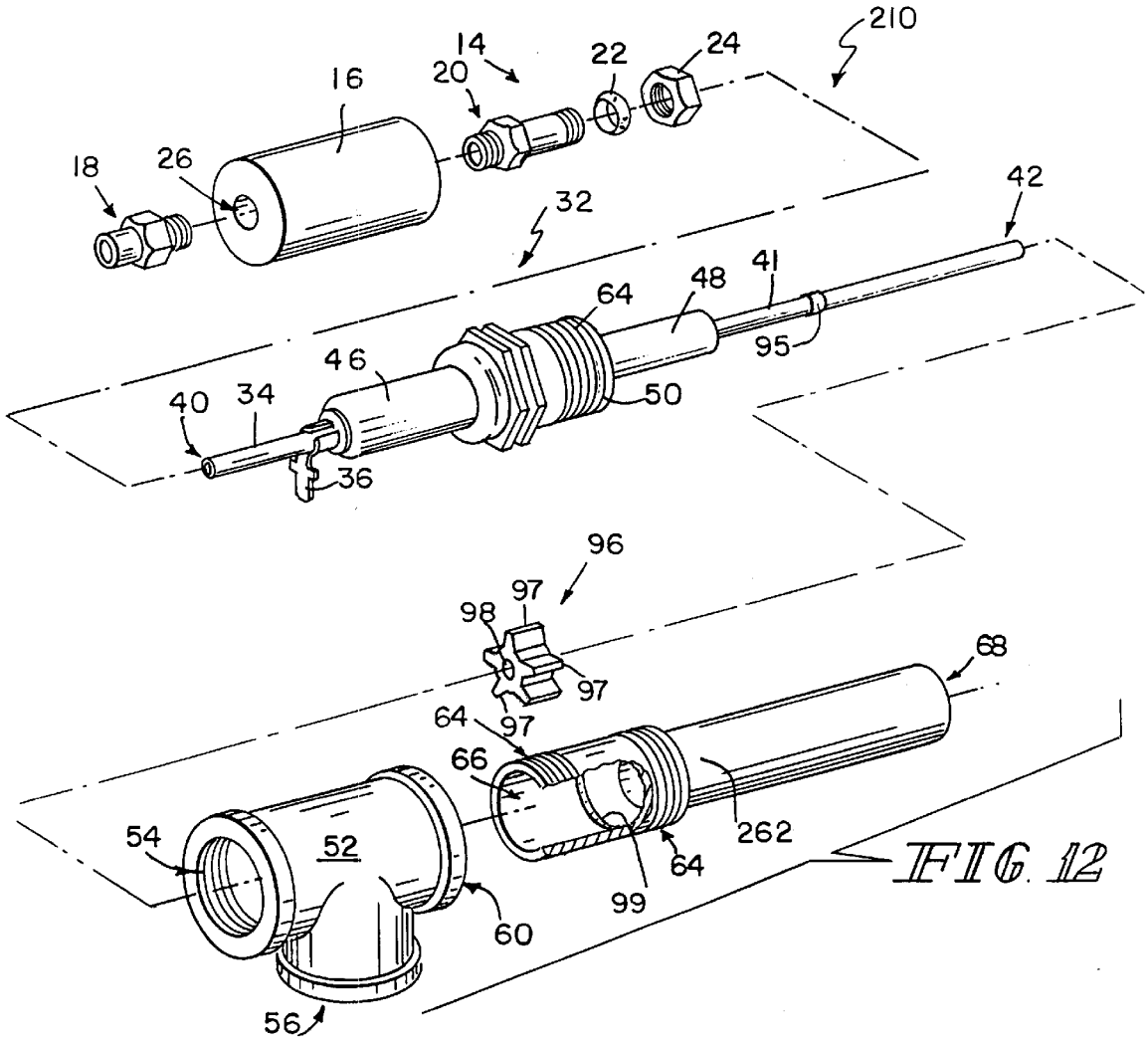
FIG. 12 is an exploded perspective view of the burner of FIG. 11 showing the star insulator positioned to lie between a counter bore formed in the outer tube and a ring coupled to the inner tube.

FIGS. 11 and 12 show another alternative burner 210 which includes a star insulator 96 and an outer tube 262 having a counter bore 99. Star insulator 96 is shown in FIG. 13 and is positioned to lie within outer tube 262 as shown in FIG. 11. Star insulator 96 is radially symmetric and includes five tips 97 and a center hole 98. Inner tube 34 is positioned to lie in center hole 98 of star insulator 96 and includes a silver soldered ring 95 that abuts star insulator 96 to position star insulator 96 against counter bore 99 formed in outer tube 262. Star insulator 96 is made of ceramic; however, star insulator may be made of any insulating materials. Star insulator 96 prevents inner tube 34 from engaging and grounding out against ignitor pin 70. In high temperatures, inner tube 34 may tend to slightly deform one way or another. Star insulator 96 supports the weight of inner tube 34 while centering inner tube 34 within outer tube 62. Star insulator 96 may also be used in place of bluff body 84 to create turbulent eddies.

Although the invention has been described in detail with reference to certain preferred embodiments, variations and modifications exist within the scope and spirit of the disclosure.

What is claimed is:

1. A burner comprising an oxygen conduit formed to include an oxygen inlet, an oxygen outlet, and an oxygen passageway extending between the oxygen inlet and oxygen outlet and including a combustion zone therein at the oxygen outlet, a spark generator including a fuel conduit formed to include a fuel inlet, a fuel outlet, and a fuel passageway extending between the fuel inlet and outlet to communicate fuel to the combustion zone to mix with oxygen extant therein, the spark generator further including an electrical current provider coupled to the fuel conduit to establish a flow of electrical current through the fuel conduit and a ground pin attached to the oxygen conduit and positioned to lie in the combustion zone established within the oxygen passageway and in a spaced-apart distance upstream of the oxygen outlet to cause an electrical arc to form in the combustion zone between the fuel conduit and the ground pin to create a spark and ignite a combustible mixture of oxygen and fuel extant in the combustion zone, and further comprising a sleeve mounted for movement relative to the fuel conduit and formed to include a central opening receiving the fuel conduit therein and wherein the fuel conduit is formed to include a pin-receiving slot communicating with the fuel outlet and the ground pin is coupled to the sleeve and arranged to move back and forth in the slot during movement of the sleeve relative to the fuel conduit to vary a spark gap distance between the fuel outlet and the ground pin in the combustion zone.

2. The burner of claim 1, wherein the fuel conduit is a tubular member and the sleeve is ring-shaped and includes an annular inner wall arranged to slide on all annular outer wall of the tubular member and the ground pin is appended to the annular inner wall.

3. A burner comprising an oxygen conduit formed to include an oxygen inlet, an oxygen outlet, and an oxygen passageway extending between the oxygen inlet and oxygen outlet and including a combustion zone therein at the oxygen outlet, a spark generator including a fuel conduit formed to include a fuel inlet, a fuel outlet, and a fuel passageway extending between the fuel inlet and outlet to communicate fuel to the combustion zone to mix with oxygen extant therein, the spark generator further including an electrical current provider coupled to the fuel conduit to establish a flow of electrical current through the fuel conduit and a ground pin attached to the oxygen conduit and positioned to lie in the combustion zone established within the oxygen passageway and in a spaced-apart distance upstream of the oxygen outlet to cause an electrical arc to form in the combustion zone between the fuel conduit and the ground pin to create a spark and ignite a combustible mixture of oxygen and fuel extant in the combustion zone, further comprising a fixture configured to mount the fuel conduit in the oxygen passageway formed in the oxygen conduit and the fixture includes an insulator coupled to the fuel conduit and a connector coupled to the insulator and the oxygen conduit to support the fuel conduit in the oxygen passageway, wherein the insulator is formed to include a passageway receiving a portion of the fuel conduit therein, and wherein a first portion of the insulator is arranged to lie in the oxygen passageway and a second portion of the insulator is arranged to lie outside of the oxygen passageway and the connector is coupled to the second portion of the insulator.

4. The burner of claim 3, wherein the electrical current provider is coupled to the fuel conduit at a point in spaced-apart relation to the oxygen conduit to position the first portion of the insulator therebetween.

5. A burner comprising an oxygen conduit formed to include an oxygen inlet, an oxygen outlet, and an oxygen passageway extending between the oxygen inlet and oxygen outlet and including a combustion zone therein at the oxygen outlet, a spark generator including a fuel conduit formed to include a fuel inlet, a fuel outlet, and a fuel passageway extending between the fuel inlet and outlet to communicate fuel to the combustion zone to mix with oxygen extant therein, the spark generator further including an electrical current provider coupled to the fuel conduit to establish a flow of electrical current through the fuel conduit and a ground pin attached to the oxygen conduit and positioned to lie in the combustion zone established within the oxygen passageway and in a spaced-apart distance upstream of the oxygen outlet to cause an electrical arc to form in the combustion zone between the fuel conduit and the ground pin to create a spark and ignite a combustible mixture of oxygen and fuel extant in the combustion zone, wherein the oxygen conduit includes an outer tube defining a downstream portion of the oxygen passageway and a housing defining an upstream portion of the oxygen passageway, the ground pin is coupled to the outer tube, and the housing is a T-shaped fitting including a first opening coupled to the outer tube, a second opening adapted to be coupled to an oxygen supply, and a third opening receiving an insulator therein, the insulator is formed to include a passageway receiving the fuel conduit therein, and further comprising a connector coupled to the insulator and the housing at the third opening to support the fuel conduit in the oxygen passageway, and wherein a first portion of the insulator is arranged to lie in the oxygen passageway and a second portion of the insulator is arranged to lie outside of the oxygen passageway and the connector is coupled to the second portion of the insulator.

6. The burner of claim 5, wherein the electrical current provider is coupled to the fuel conduit in spaced-apart relation to the oxygen conduit to position the first portion of the insulator therebetween.

7. A burner comprising an oxygen conduit formed to include an oxygen inlet, an oxygen outlet, and an oxygen passageway extending between the inlet and outlet and including a combustion zone therein at the oxygen outlet, a spark generator including a fuel conduit having a fuel inlet, a fuel outlet, and a fuel passageway extending therebetween to communicate fuel to the combustion zone in the oxygen passageway, the fuel outlet of the fuel conduit being positioned to lie in the passageway of the oxygen conduit in spaced-apart relation to the oxygen outlet of the oxygen conduit position the combustion zone therebetween, the spark generator further including an electrical ground connector coupled to the oxygen conduit and electrical current provider coupled to the fuel conduit at a point in spaced-apart relation to the oxygen outlet to position the oxygen inlet therebetween, the spark generator being configured to create a spark within the extant in the combustion zone, and an insulator in contact with the fuel conduit and formed to include a passageway receiving the fuel conduit therein, at least a portion of the insulator being positioned to lie between the electrical current provider and the oxygen inlet.

8. The burner of claim 7, wherein the electrical current provider includes a clip coupled to the fuel conduit and a lead connector appended to the clip and adapted to be coupled to a power supply.

9. The burner of claim 7, wherein the oxygen conduit includes an outer tube defining a downstream portion of the oxygen passageway and a housing defining an upstream portion of the oxygen passageway, a portion of the insulator is arranged to lie in the housing, the burner further comprising a connector arranged to couple the insulator to the housing to support the fuel conduit in a fixed position in the oxygen passageway, and wherein the insulator is arranged to block flow of electrical current from the fuel conduit to the ground connection coupled to the oxygen conduit through the housing.

10. The burner of claim 9, wherein the insulator is formed to include a first insulator block and a second insulator block in spaced-apart relation to the first insulator block and the connector is positioned to lie between the first and second insulator blocks.

11. The burner of claim 10, wherein the housing includes a first opening threadably coupled to the outer tube of tbe oxygen conduit, a second opening adapted to be coupled to an oxygen supply, and a third opening threadably coupled to the connector.

12. The burner of claim 7, wherein the electrical ground connector includes a ground line and a pin coupled to the ground line and the oxygen conduit and positioned to lie in the combustion zone within the passageway of the oxygen conduit between the outlet of the fuel conduit and the outlet of the oxygen conduit.

13. A burner comprising a spark generator having a power supply, an ignitor clip coupled to the power supply, an inner tube coupled to the ignitor clip and formed to include an inlet and an outlet spaced apart from the inlet, the inner tube defining a passageway extending between the inlet and outlet of the inner tube to communicate fuel to a combustion zone, and a grounded ignition pin, the spark generator being configured to create a spark between the ignition pin, and the inner tube being positioned to lie in spaced-apart relation to the ignition pin, an outer tube including an inlet and an outlet spaced apart from the inlet, the outer tube defining a passageway extending between the inlet and outlet of the outer tube and including the combustion zone therein to communicate oxygen to the combustion zone, and an ignitor insulator having a passageway configured to receive the inner tube therein, the ignitor insulator being coupled to and positioned to lie between the igniter clip of the spark generator and a housing coupled to an outer tube in order to insulate the housing and outer tube from the spark generator.

14. The burner of claim 13, wherein the inner tube, housing, outer tube, ignitor clip, and igniter insulator of the burner assembly are positioned to lie along a horizontal axis.

15. The burner of claim 14, wherein the outlet of the outer tube is spaced apart from the outlet of the inner tube along a longitudinal axis of the burner, and the ignition pin is coupled to an inner surface of the outer tube and positioned to lie between the outlet of the inner tube conduit and the outlet of the outer tube conduit along the longitudinal axis of the burner.

16. The burner of claim 15, wherein a flame is ignited in the combustion zone and the combustion zone is positioned to lie within the outer tube and between the second end of the inner tube and the second end of the outer tube along the longitudinal axis of the burner.

17. The burner of claim 15, wherein the fuel is urged to run through the inner tube and upon exiting the inner tube at the outlet of the inner tube, the fuel passes over the ignitor pin within the passageway of the outer tube.

18. The burner of claim 13, wherein the ignitor clip is formed to include an aperture and the inner tube is received within the aperture.

19. The burner of claim 13, further comprising a second insulator formed to include a passageway configured to communicate the fuel from a fuel supply to the passageway of the inner tube and the second insulator is positioned to electrically insulate the fuel supply from the electric spark generator.

* * * * *